US009969189B2

(12) United States Patent
Nihashi

(10) Patent No.: US 9,969,189 B2
(45) Date of Patent: May 15, 2018

(54) PRINTER

(71) Applicant: TOSHIBA TEC KABUSHIKI KAISHA, Shinagawa-ku, Tokyo (JP)

(72) Inventor: Kiyotaka Nihashi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/340,051

(22) Filed: Nov. 1, 2016

(65) Prior Publication Data

US 2017/0144458 A1 May 25, 2017

(30) Foreign Application Priority Data

Nov. 19, 2015 (JP) ..... 2015-226672

(51) Int. Cl.

| | |
|---|---|
| ***B41J 15/02*** | (2006.01) |
| ***B41J 15/04*** | (2006.01) |
| ***B41J 11/58*** | (2006.01) |
| ***B41J 3/407*** | (2006.01) |

(52) U.S. Cl.

CPC ..... *B41J 11/58* (2013.01); *B41J 3/4075* (2013.01); *B41J 15/02* (2013.01)

(58) Field of Classification Search

CPC ..... B41J 13/00; B41J 13/0009; B41J 15/00; B41J 15/04; B41J 15/044; B41J 15/046; B65H 18/02; B65H 18/08; B65H 18/103; B65H 18/145; B65H 18/28

See application file for complete search history.

(56) References Cited

U.S. PATENT DOCUMENTS

| | | | | |
|---|---|---|---|---|
| 5,813,343 | A | 9/1998 | Harb | |
| 2005/0147452 | A1* | 7/2005 | Sugimoto | B41J 3/4075 400/613 |

* cited by examiner

*Primary Examiner* — Kristal Feggins
(74) *Attorney, Agent, or Firm* — Amin, Turocy & Watson LLP

(57) ABSTRACT

There is provided a printer including, in a sheet holding section configured to hold roll paper formed by rolling a printing target sheet, a pair of pressing sections configured to hold the roll paper from both side ends, and a holding section provided in each of the pressing section. The holding section is displaceable to a first position where the holding section projects to a side opposed to a side end portion of the roll paper and a second position where the holding section does not project. The holding section enters a cylindrical portion in a rolling center of the roll paper in the first position to hold the roll paper.

20 Claims, 13 Drawing Sheets

PRINTER

CROSS-REFERENCE TO RELATED APPLICATIONS

This application is based upon and claims the benefit of priority from Japanese Patent Application No. 2015-226672, filed Nov. 19, 2015, the entire contents of which are incorporated herein by reference.

FIELD

Embodiments described herein relate generally to a printer.

BACKGROUND

A printer that issues a label and a receipt is used in the related art. A sheet holding section of the printer rotatably holds a label roll and a receipt roll.

The label roll is formed by sticking labels to a belt-like mount and rolling the labels or a label roll formed by rolling belt-like labels without a mount. When the label roll is used, the center of the roll needs to be held. Therefore, the sheet holding section includes a pair of projected members and a shaft that enter the inner circumference of the label roll.

On the other hand, the receipt roll has an inner diameter different from (generally smaller than) the inner diameter of the label roll. There are a variety of receipt roll types. Further, a frequency of use and resupply of the receipt roll is high. Therefore, the sheet holding section often holds the receipt roll in a so-called throwing-in type rather than entering the inner circumference of the receipt roll and holding the receipt roll.

It is assumed that the receipt roll is held by the sheet holding section including the convex sections, which hold the rolling center of the label roll, in the throwing-in type. In this case, both side ends of the roll are pressed by the tops of the convex sections while a roll diameter is large. However, if the roll diameter decreases, the roll enters under the convex sections and both the side ends cannot be pressed. Therefore, in such an operation, the receipt roll is likely to flap in the sheet holding section.

It is inconvenient to directly use, for the holding of the receipt roll, the sheet holding section including the convex sections and the like to hold the label roll.

DESCRIPTION OF THE DRAWINGS

FIGS. 12A and 12B are longitudinal sectional views of a pressing section, a holding section, and a support structure in a second embodiment, wherein FIG. 12A is a view showing a state in which the holding section is present in the first position and FIG. 12B is a view showing a state in which the holding section is present in the second position;

FIGS. 13A to 13C are views of a pressing section and a holding section in a third embodiment, wherein FIG. 13A is a longitudinal sectional view showing a state in which the holding section is present in the first position, FIG. 13B is a perspective view of the state shown in FIG. 13A, and FIG. 13C is a longitudinal sectional view showing a state in which the holding sections is present in the second position; and FIGS. 14A and 14B are longitudinal sectional views of a pressing section and a holding section in a fourth embodiment, wherein FIG. 14A is a view showing a state in which the holding section is present in the first position and FIG. 14B is a view showing a state in which the holding section is present in the second position.

DETAILED DESCRIPTION

An object of embodiments is to provide a printer in which both of a label roll and a receipt roll can be used.

In general, according to one embodiment, there is provided a printer including, in a sheet holding section configured to hold roll paper formed by rolling a printing target sheet, a pair of pressing sections configured to hold the roll paper from both side ends, and a holding section provided in each of the pressing section. The holding section is displaceable to a first position where the holding section projects to a side opposed to a side end portion of the roll paper and a second position where the holding section does not project. The holding section enters a cylindrical portion in a rolling center of the roll paper in the first position to hold the roll paper.

First Embodiment

Figure 1:
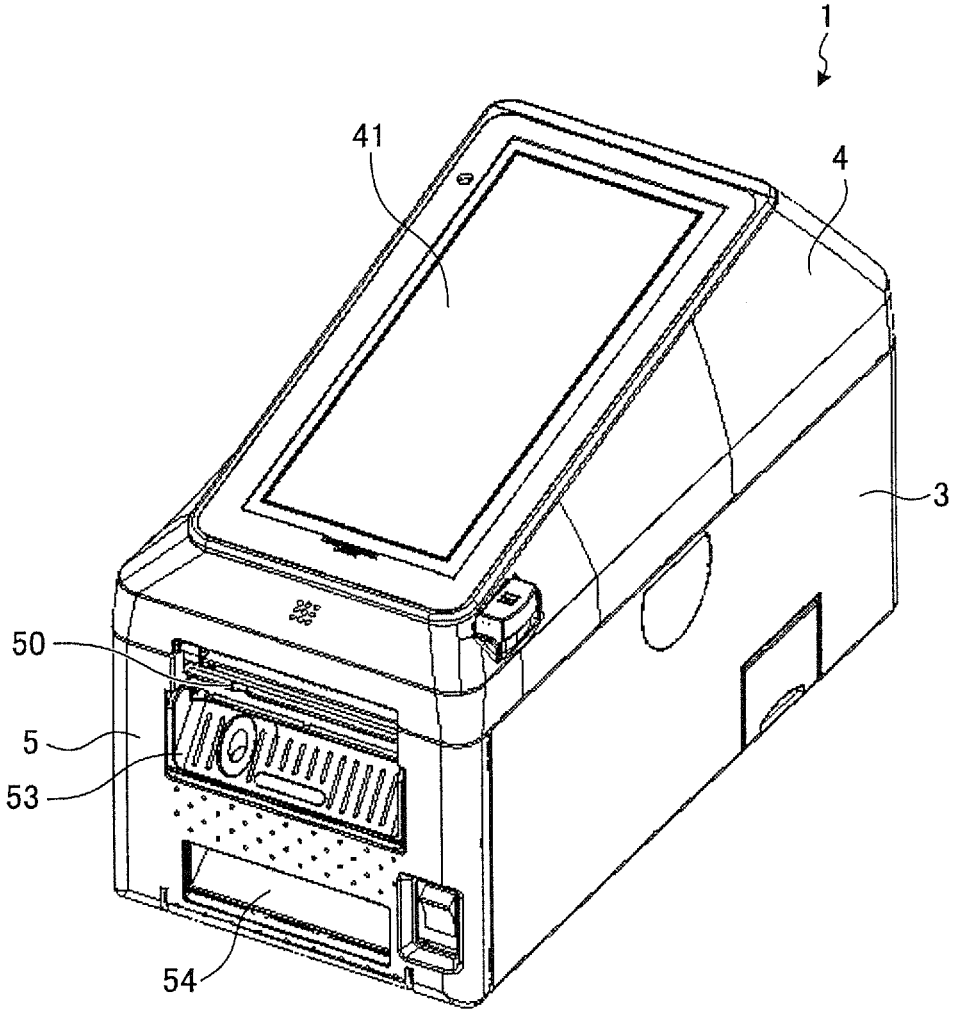
FIG. 1 is a perspective view showing the exterior of a printer according to a first embodiment.

A first embodiment is explained with reference to the drawings. FIG. 1 is a perspective view showing the exterior of a printer 1 according to the first embodiment. The printer 1 includes a printer main body 2, a lower case 3, an upper case 4, and a front cover 5.

Figure 2:
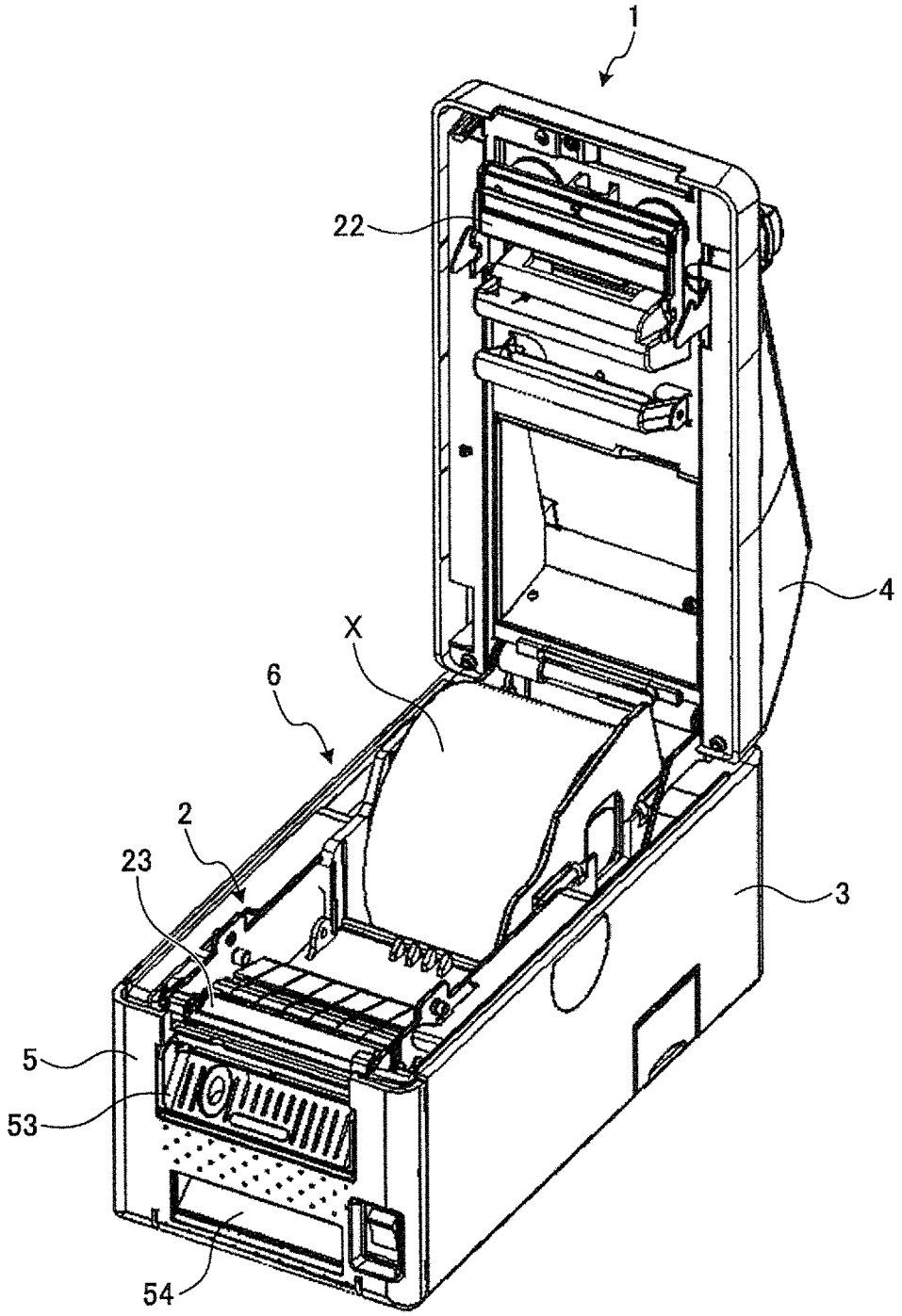
FIG. 2 is a perspective view showing a state in which an upper case of the printer is opened.

FIG. 2 is a perspective view showing a state in which the upper case 4 of the printer 1 is opened. The printer 1 further includes a sheet storing section 6. The lower case 3, the upper case 4, and the front cover 5 cover the printer main body 2 and the sheet storing section 6.

The sheet storing section 6 is an example of a sheet holding section and is a container opened in an upper surface that houses and holds roll paper X formed by rolling a belt-like sheet in a roll shape. As the roll paper X, for example, there is a receipt roll and a label roll. The receipt roll is formed by rolling a belt-like sheet serving as receipts.

The label roll is formed by sticking labels to a belt-like mount and rolling the labels with the mount (a label sheet).

The lower case 3 is a rectangular parallelepiped case opened in an upper surface and a front surface. The upper surface is closed by the upper case 4 and the front surface is closed by the front cover 5. In the lowercase 3, for example, a connection terminal (not shown in the figure) used for connection of the printer main body 2 on the inside and an external apparatus and a power supply terminal (not shown in the figure) for supplying electric power to the printer main body 2 are provided.

A side on the rear surface side of the upper case 4 is turnably attached to the lower case 3. According to the turning, the upper case 4 opens and closes the opening on the upper surface of the lower case 3. The upper case 4 includes a touch panel display 41 on the upper surface. The touch panel display 41 receives inputs of various kinds of operation and displays various kinds of information.

A paper discharge port 50 that discharges sheets is provided between the upper end portion of the front cover 5 and the front end lower portion of the upper case 4.

The front cover 5 includes a paper discharge guide 53 and a mount discharge port 54. The paper discharge guide 53 guides a sheet to be discharged. If a sheet is a label with a mount and is peeled and issued, the mount discharge port 54 discharges the mount after the label is peeled. The front cover 5 covers the front surface of the printer main body 2 to be capable of opening and closing.

The printer main body 2 includes a thermal head 22 and a platen roller 23. The thermal head 22 is fixed to the inner side surface of the upper case 4. The thermal head 22 adheres to the platen roller 23 in a state in which the upper case 4 closes the opening of the upper surface of the lower case 3.

The thermal head 22 includes a plurality of heat generating bodies provided in parallel. The thermal head 22 performs, with heat of the heat generating bodies, printing on a sheet held between the thermal head 22 and the platen roller 23.

The platen roller 23 rotates when a driving force of a stepping motor (not shown in the figure) is transmitted to the platen roller 23 and conveys the sheet held between the platen roller 23 and the thermal head 22.

Figure 3:
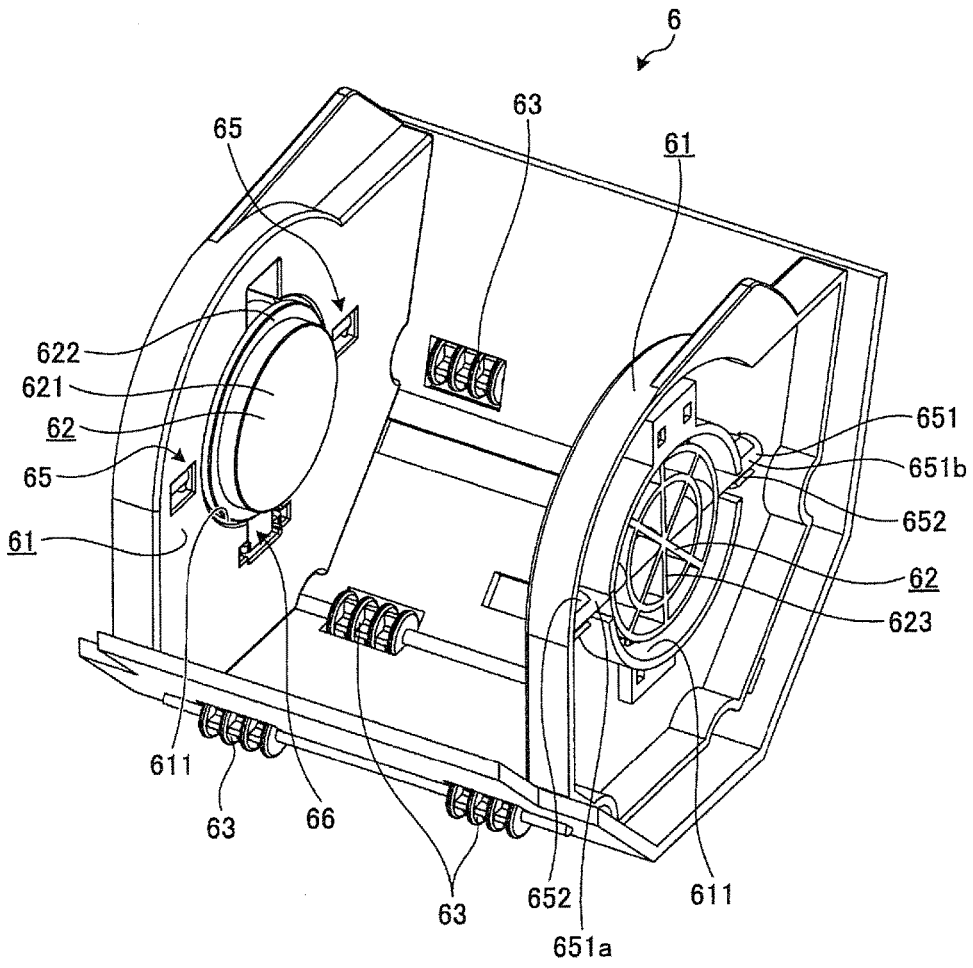
FIG. 3 is a perspective view of a sheet storing section and is a view showing a state suitable when a label roll is used as roll paper.
Figure 4:
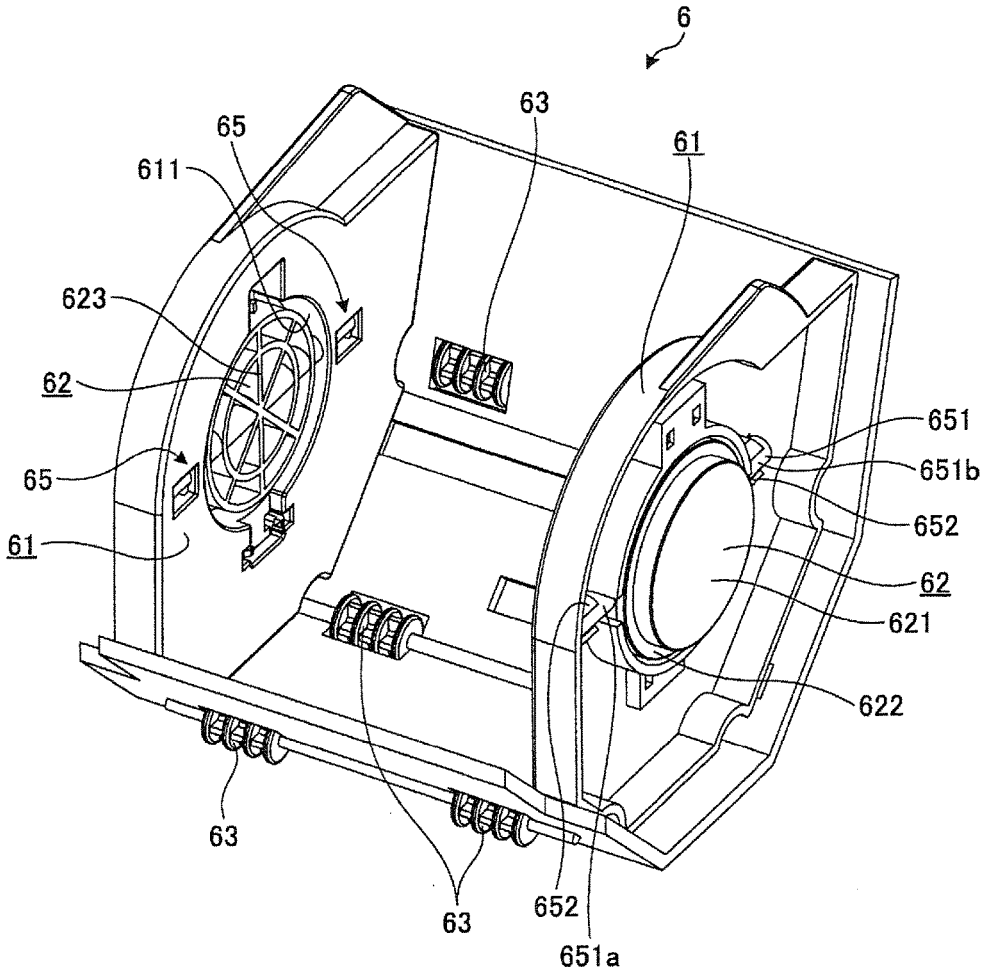
FIG. 4 is a perspective view of the sheet storing section and is a view showing a state suitable when a receipt roll is used as the roll paper.
Figure 5:
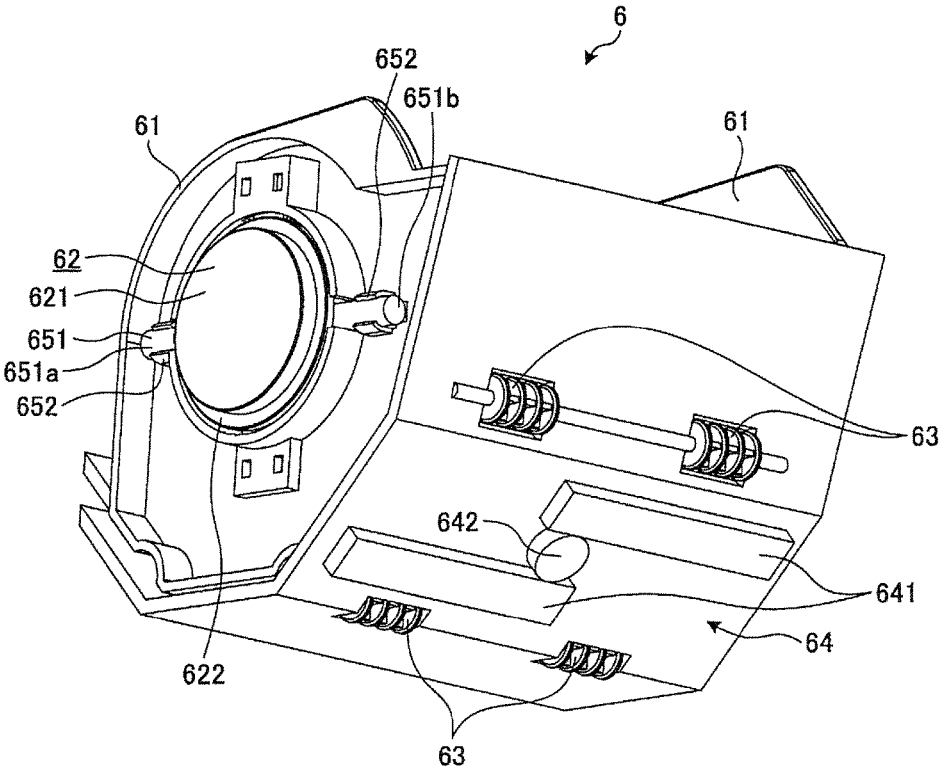
FIG. 5 is a perspective view of the sheet storing section in the state shown in FIG. 4 viewed from the outer side.

FIGS. 3 to 5 are perspective views of the sheet storing section 6. The sheet storing section 6 including a pair of pressing sections 61, a pair of holding sections 62, rollers 63, and a rack and pinion 64. FIG. 3 shows a state suitable when a label roll is used as roll paper X. FIG. 4 shows a state suitable when a receipt roll is used as the roll paper X. FIG. 5 is a view of the sheet storing section 6 in the state shown in FIG. 4 viewed from the outer side.

The pressing sections 61 are members configuring sidewalls of the sheet storing section 6. The pair of pressing sections 61 is capable of moving, with the rack and pinion 64, in directions in which the pressing sections 61 approach and separate from each other. The rack and pinion 64 is configured by a pair of rack gears 641 parallel to each other with tooth surfaces thereof opposed to each other and a pinion gear 642 that meshes with the rack gears 641. The pair of pressing sections 61 holds the roll paper X from both side ends to thereby press the roll paper X not to move in the width direction. The roll paper X is positioned on the basis of the width direction center by the pressing sections 61.

The holding sections 62 are provided in the pressing sections 61 and are displaceable to a first position where the holding sections 62 project to a side opposed to the side end portion of the roll paper X (i.e., into the sheet storing section 6) and a second position where the holding sections 62 do not project. The holding sections 62 shown in FIG. 3 are present in the first position and are in a state suitable when the label roll is used as the roll paper X. The holding sections 62 shown in FIGS. 4 and 5 are present in the second position and are in a state suitable when the receipt roll is used as the roll paper X.

Figure 6:
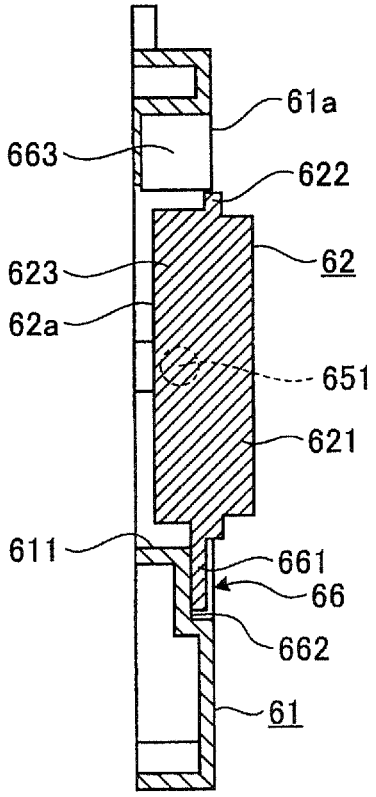
FIG. 6 is a sectional view showing a holding section and a pressing section present in a first position.
Figure 7:
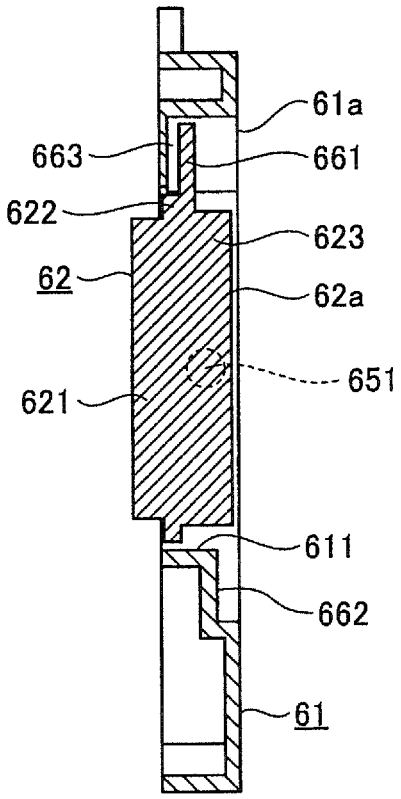
FIG. 7 is a sectional view showing the holding section and the pressing section present in a second position.

FIG. 6 is a sectional view showing the holding section 62 and the pressing section 61 present in the first position. FIG. 7 is a sectional view showing the holding section 62 and the pressing section 61 present in the second position. In both the views, the right side of the views is the inner side of the sheet storing section 6, that is, the side opposed to the side end portion of the roll paper X. The holding section 62 rotates approximately 180° to thereby move from the first position to the second position. If the holding section 62 is present in the first position, the holding section 62 enters a cylindrical portion in the rolling center of the roll paper X to thereby hold the roll paper X.

As a method of setting the roll paper X in the sheet storing section 6, there are a shaft holding type for rotatably holding the rolling center and a so-called throwing-in (drop-in) type for not holding the rolling center.

The label roll is easily deformed if being left untouched with the rolling center laid sideways. Therefore, if the label roll is used in the throwing-in type, the label roll is sometimes deformed to be unable to be drawn out or to be less easily drawn out. Therefore, the label roll is used in the shaft holding type.

Since the receipt roll is rolled densely compared with the label roll, the receipt roll is less easily deformed even if the receipt roll is placed with the rolling center laid sideways. A frequency of supply of the receipt roll is high. Because of these reasons, the receipt roll is used in the throwing-in type as well.

If the roll paper X is used in the throwing-in type, the rollers 63 separate the outer circumference of the roll paper X from the inner side surface of the sheet storing section 6 and rotate according to the rotation of the roll paper X. That is, the rollers 63 prevent friction between the outer circumferential surface of the roll paper X and the inner side surface of the sheet storing section 6 to allow the roll paper X to easily rotate.

If the roll paper X is used in the throwing-in type, when the diameter of the roll paper X decreases according to consumption of the sheet, the roll paper X is sometimes lifted from the bottom of the sheet storing section 6 when the sheet is drawn out. Therefore, in the case of the throwing-in type, if the holding section 62 is present in the first position, the roll paper X is likely to be caught by the holding section 62. Therefore, in the printer 1 in this embodiment, in the case of the throwing-in type, the holding section 62 is set to be located in the second position.

Various structures is proposed to meet various needs in a printer in the related art. However, detachable components are sometimes used in the structures. In this case, an inconvenience could occur in which a detached and stored component is lost and a function cannot be used. In order to eliminate the inconvenience, in the printer 1 in this embodiment, the holding section 62 is displaced by being moved without being detached from the sheet storing section 6. That is, in the printer 1, a loss of the holding section 62 is unlikely to occur.

The holding section 62 includes a convex section 621. The convex section 621 is a portion that enters the cylindrical portion in the rolling center of the roll paper X. The convex section 621 is circular and has a size fit in a paper tube (a core) of the label roll, which is a cylindrical member. If the holding section 62 is present in the first position, the convex section 621 receives a load from the roll paper X.

The holding section 62 includes, on the rear side of a surface opposed to the side end portion of the roll paper X in the first position, a surface opposed to the side end portion of the roll paper X in the second position. That is, a surface 62*a* on the rear side of the convex section 621 is opposed to the side end portion of the roll paper X if the holding section 62 is present in the second position.

The holding section 62 includes a flange 622 around the convex section 621. The height of the flange 622 is a degree slightly projecting from the pressing section 61. The flange 622 is in contact with the end face of the paper tube of the label roll to press the paper tube. That is, the flange 622 forms a slight gap between the pressing section 61 and the end face of the label roll to prevent the pressing section 61 and the end face of the label roll from adhering. That is, the flange 622 creates a state in which the label roll can easily rotate.

The pressing section 61 includes a hole 611. The hole 611 is a through-hole and is formed in a shape substantially coinciding with the outer circumferential shape of the holding section 62. The thickness of the pressing section 61 is larger than the thickness of a base section 623, which is a foundation portion of the holding section 62. That is, the hole 611 houses the base section 623.

The surface 62*a* of the holding section 62 is a surface on a side opposed to the end face of the roll paper X when the holding section 62 is present in the second position. The surface 62*a* is located on the same plane of a surface 61*a* of the pressing section 61 on the side opposed to the end face of the roll paper X or is retracted further to the inner side of the hole 611 than the surface 61*a*. In the latter case, the edge (the boundary with the surface 61*a*) of the hole 611 is chamfered not to catch the roll paper X.

As shown in FIGS. 3 and 4, the base section 623 is hollow on the rear surface side of the convex section 621. A reinforcing rib is erected in the base section 623.

The printer 1 includes a support structure 65 between the holding section 62 and the pressing section 61. The support structure 65 supports the holding section 62 to be movable between both of the first position and the second position.

The support structure 65 includes a rotating shaft 651 provided in the base section 623 and a shaft supporting section 652 provided in the pressing section 61. The support structure 65 supports the holding section 62 to be rotatable around the rotating shaft 651 and moves the holding section 62 between the first position and the second position according to the rotation. In the movement, the holding section 62 does not need to be detached from the pressing section 61.

The rotating shaft 651 passes substantially the center of the holding section 62. Therefore, when moving between the first position and the second position, the holding section 62 is rotated approximately 180° with respect to the pressing section 61. The rotating shaft 651 is provided in parallel to the side end portion of the roll paper X. Therefore, the holding section 62 is turn inside out and vertically reversed according to the movement between the first position and the second position.

The rotating shaft 651 includes, at both ends, a pair of projecting sections 651*a* and 651*b* projecting from the outer edge of the base section 623. The shaft supporting section 652 rotatably supports the projecting sections 651*a* and 651*b*. The rotating shaft 651 supported by the shaft supporting section 652 is generally orthogonal to a throwing-in direction of the roll paper X. The rotating shaft 651 in this embodiment takes a substantially horizontal posture in a state in which the printer 1 is placed in a desk or the like.

Figure 8:
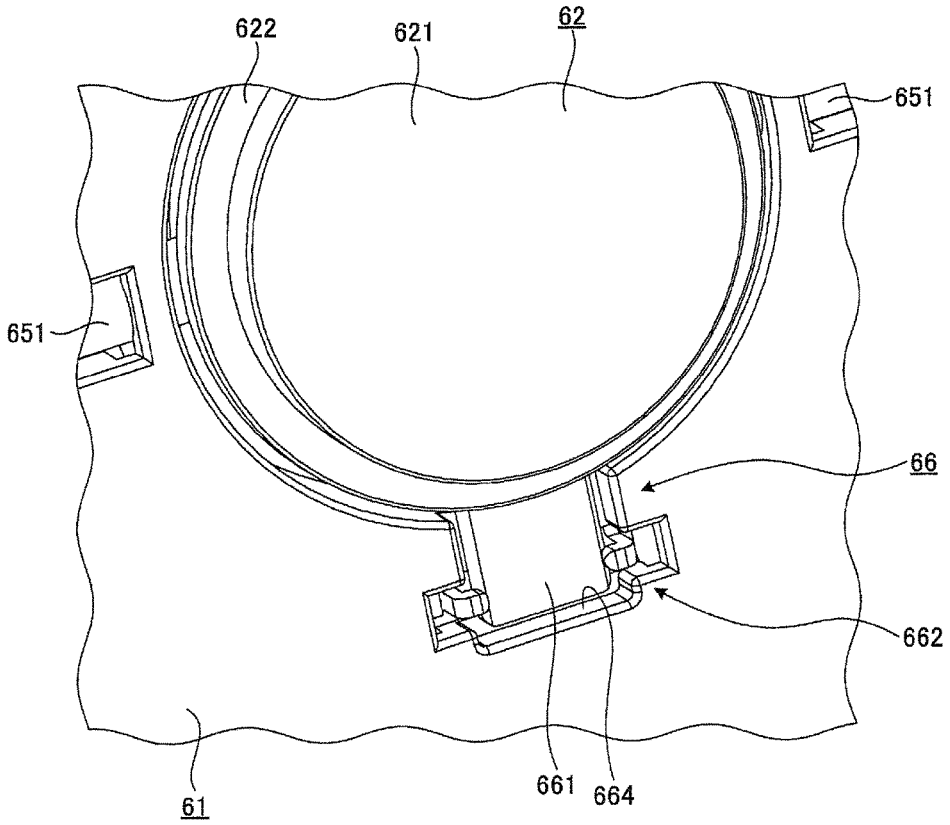
FIG. 8 is a perspective view showing the exterior of a whirl-stop section and showing a state in which a tab is grasped by a tab grasping section.

A whirl-stop section 66 is provided between the holding section 62 and the pressing section 61. FIG. 8 is a perspective view showing the exterior of the whirl-stop section 66. The whirl-stop section 66 includes a tab 661 and a tab grasping section 662 provided in the pressing section 61.

Figure 9:
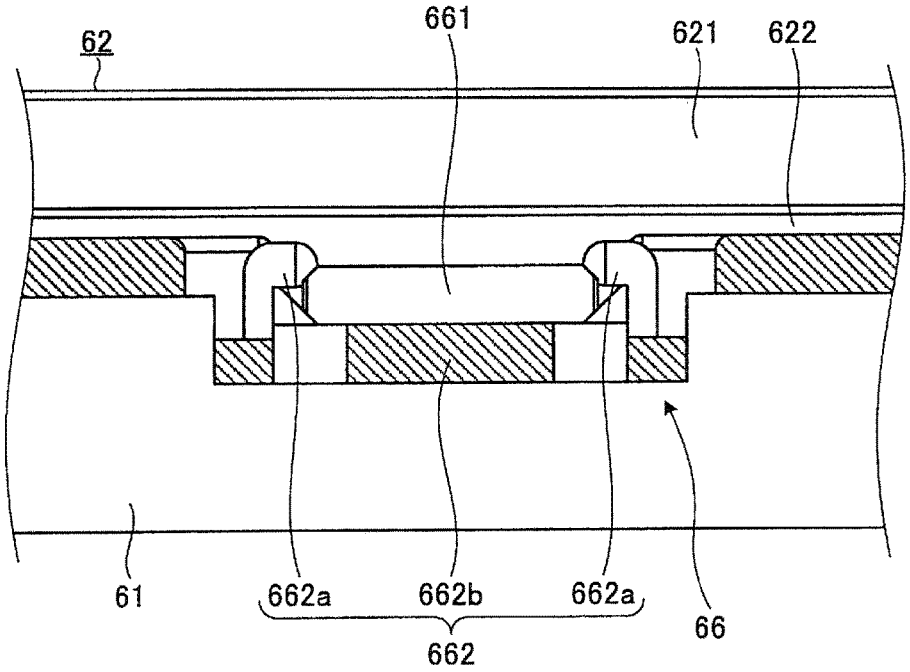
FIG. 9 is a sectional view for explaining the structure of the whirl-stop section and showing a state in which the tab is grasped by the tab grasping section.
Figure 10:
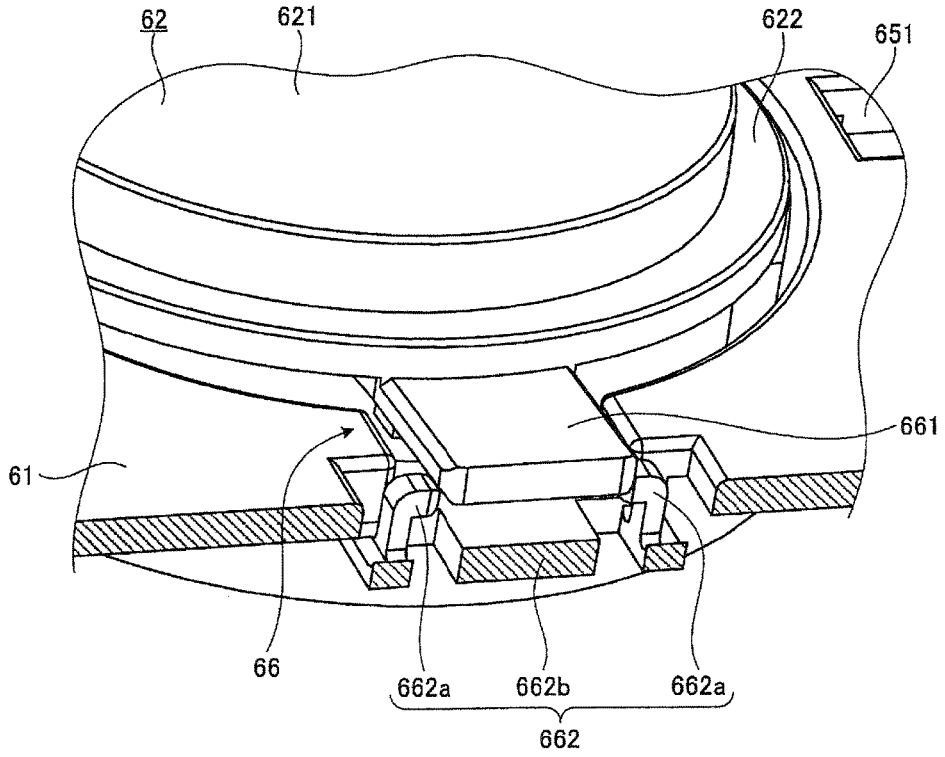
FIG. 10 is a perspective view for explaining the structure of the whirl-stop section and showing a state immediately before the tab is grasped by the tab grasping section.
Figure 11:
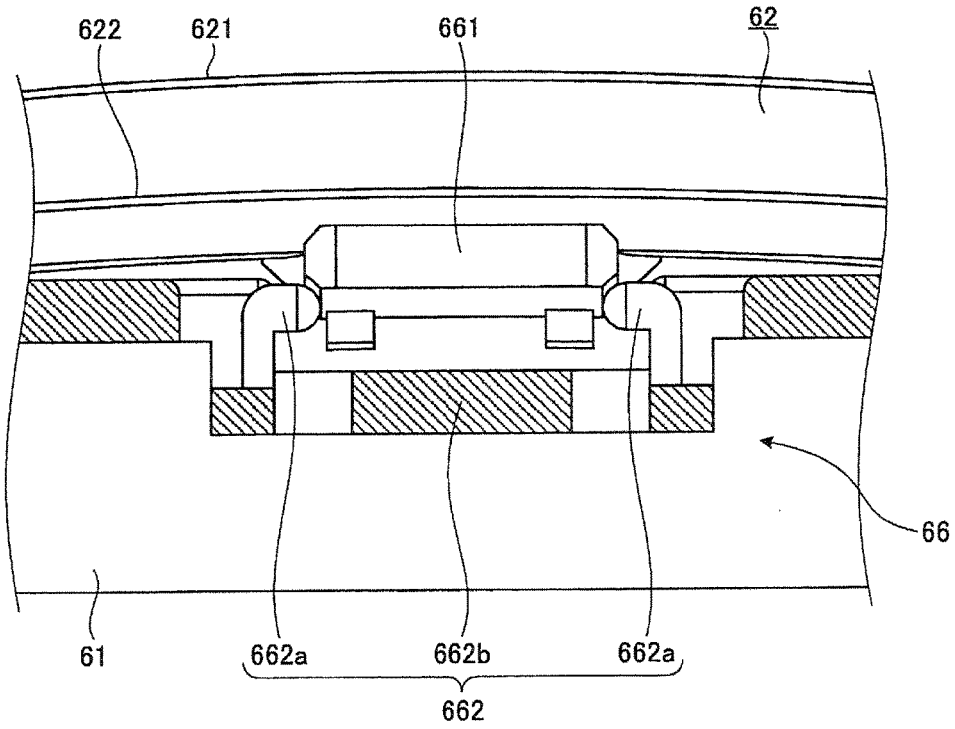
FIG. 11 is a sectional view for explaining the structure of the whirl-stop section and showing the state immediately before the tab is grasped by the tab grasping section.

Further, FIGS. 9 to 11 are views for explaining the structure of the whirl-stop section 66. Like FIG. 8, a sectional view of FIG. 9 shows a state in which the tab 661 is grasped by the tab grasping section 662. A perspective view of FIG. 10 and a sectional view of FIG. 11 show a state immediately before the tab 661 is grasped by the tab grasping section 662.

The tab 661 is a thin tabular portion projecting further to the outer side (a radial direction) from the flange 622 to extend along a direction orthogonal to the rotating shaft 651 from the center of the convex section 621. The rotating shaft 651 in this embodiment is substantially horizontal in the state in which the printer 1 is placed on the desk or the like. Therefore, although an extending direction of the tab 661 in the first position is upward or downward, the tab 661 is more effective as a whirl stop if the tab 661 extends downward as shown in FIGS. 3 and 6.

The tab grasping section 662 includes a pair of claw members 662*a* and a positioning member 662*b*. The pair of claw members 662*a* grasps the tab 661 to hold the tab 661 from both directions orthogonal to the extending direction. The positioning member 662*b* is a flat member with which a plane portion of the tab 661 held by the claw members 662*a* is in contact. The positioning member 662*b* decides a rotating position of the tab 661 around the rotating shaft 651.

The whirl-stop section 66 functions when the holding section 62 is present in the first position. The first position is a state in which the convex section 621 of the holding section 62 holds the roll paper X by entering the cylindrical portion in the rolling center of the roll paper X. A downward load is applied from the roll paper X to the holding section 62 that is holding the roll paper X. To prevent the holding section from unintentionally rotating with the load, the tab grasping section 662 provided on the inner side of the sheet storing section 6 in this embodiment is disposed on the lower side of the holding section 62.

The pressing section 61 includes a tab housing section 663. The tab housing section 663 is disposed on the opposite side across the hole 611 of the tab grasping section 662. The tab housing section 663 is a release groove for fitting the tab 661 present on the upper side of the holding section 62 within the thickness of the pressing section 61 when the holding section 62 is present in the second position. The tab housing section 663 includes a clip (not shown in the figures) that simply positions the tab 661 in order to prevent the holding section 62 from suddenly rotating when the holding section 62 is present in the second position. The clip may be configured the same as the tab grasping section 662.

Further, the pressing section 61 includes a concave section 664 on the lower side of the tab grasping section 662. The concave section 664 is a space for making it easy to hook a nail or the like on the lower side of the tab 661 grasped by the tab grasping section 662 and facilitating release of the grasping of the tab 661. Note that the release of the grasping of the tab 661 may be performed by pushing the end on the upper side of the convex section 621.

In such a configuration, if the label roll is used as the roll paper X, the holding section 62 is placed in the first position. Subsequently, the convex section 621 is inserted into the paper tube of the label roll and the pressing section 61 is positioned such that the flange 622 is in contact with the end face of the paper tube. Consequently, it is possible to hold the label roll to be easily drawn out.

If the receipt roll is used as the roll paper X, the holding section 62 is placed in the second position and the receipt roll is inserted into the sheet storing section 6. The pressing section 61 is positioned to match the width of the receipt roll.

In this way, according to the first embodiment, it is possible to displace the holding section 62 to the first position and the second position. Therefore, it is possible to provide the printer 1 for both of a label and a receipt capable of performing printing in both of the type for holding the rolling center of the roll paper X and the throwing-in type.

According to this embodiment, it is possible to continuously move the holding section 62 between the first position and the second position without detaching the holding section 62 from the pressing section 61. Therefore, it is possible to obtain the printer 1, a component of which is less easily lost.

Second Embodiment

A second embodiment is explained below. This embodiment is a modification of the first embodiment. In the explanation of this embodiment, explanation concerning portions same as the portions in the first embodiment is omitted. Portions different from the portions in the first embodiment are explained. In this embodiment, the portions same as the portions in the first embodiment are denoted by the same reference numerals and signs.

Figure 12A:
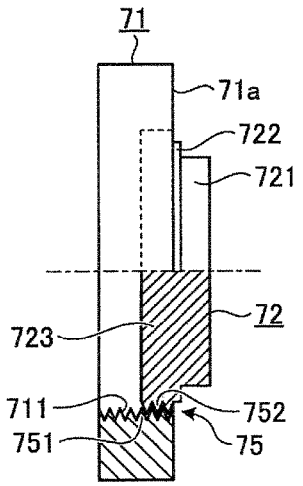
Figure 12B:
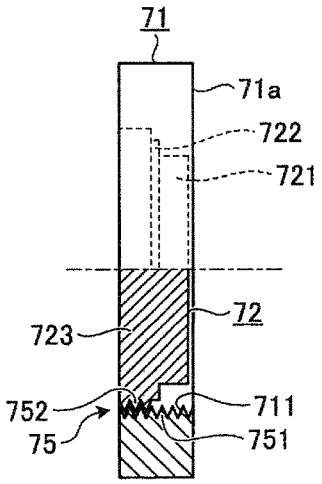

FIGS. 12A and 12B are longitudinal sectional views of a pressing section 71, a holding section 72, and a support structure 75 in the second embodiment. FIG. 12A shows a state in which the holding section 72 is present in the first position. FIG. 12B shows a state in which the holding section 72 is present in the second position. The support structure 75 in this embodiment includes a female screw 751 provided in the pressing section 71 and a male screw 752 provided in the holding section 72.

A base section 723 of the holding section 72 is circular. The pressing section 71 includes a circular hole 711 that the holding section 72 enters and exits. The female screw 751 is provided in the inner circumference of the hole 711. The male screw 752 is provided in the outer circumference of the base section 723 of the holding section 72.

Note that a convex section 721 and a flange 722 of the holding section 72 are the same as the convex section 621 and the flange 622 of the holding section 62 in the first embodiment.

The female screw 751 and the male screw 752 mesh with each other to thereby position the holding section 72 with respect to the pressing section 71 and support the holding section 72. In a state in which the male screw 752 meshes with the female screw 751, the holding section 72 is rotatable with respect to the pressing section 71. A rotation axis of the rotation is orthogonal to the side end portion of roll paper. According to the rotation around the rotation axis, the holding section 72 is movable in a direction in a direction in which the holding section 72 enters and exit a surface 71*a* of the pressing section 71 on a side opposed to the end face of the roll paper X.

In this way, according to the second embodiment, by rotating the holding section 72 with respect to the pressing section 71, it is possible to continuously move the holding section 72 between the first position and the second position without detaching the holding section 72 from the pressing section 71. Therefore, it is possible to obtain effects same as the effects in the first embodiment.

Note that, although not particularly explained in the embodiments, a hole, a knob protrusion, or the like, into which a fingertip can be inserted, may be provided in the holding section 72 to make it easy to rotate the holding section 72.

Third Embodiment

A third embodiment is explained below. This embodiment is a modification of the first embodiment. In the explanation of this embodiment, explanation concerning portions same as the portions in the first embodiment is omitted. Portions different from the portions in the first embodiment are explained. In this embodiment, the portions same as the portions in the first embodiment are denoted by the same reference numerals and signs.

Figure 13A:
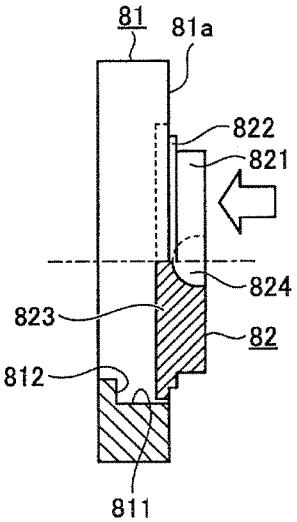
Figure 13B:
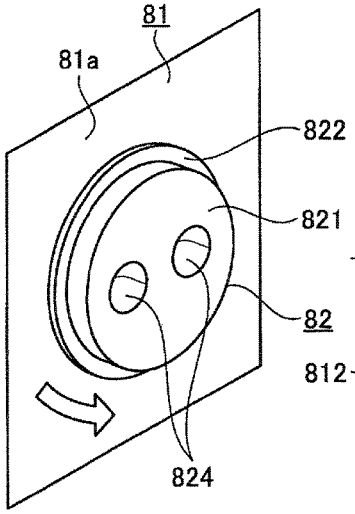
Figure 13C:
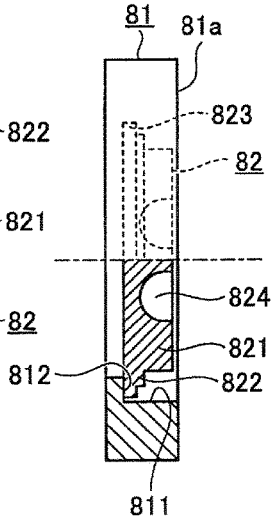

FIGS. 13A to 13C are views of a pressing section 81 and a holding section 82 in the third embodiment. FIG. 13A is a longitudinal sectional view showing a state in which the holding section 82 is present in the first position. FIG. 13B is a perspective view of the state shown in FIG. 13A. FIG. 13C is a longitudinal sectional view showing a state in which the holding section 82 is present in the second position.

The pressing section 81 includes a circular hole 811 that the holding section 82 enters and exits. The pressing section 81 includes a feed-stop section 812, which has an inner diameter smaller than the hole 811, on an inner side when the hole 811 is viewed from a side opposed to the side end portion of the roll paper X.

The feed-stop section 812 presses the sufficiently fed holding section 82 on the inner side of the hole 811. "Sufficiently" means a degree in which the holding section 82 does not project from a surface 81*a* of the pressing section 81 on the side opposed to the end face of the roll paper X. The feed-stop section 812 also plays a role of preventing the holding section 82 from coming off the inner side of the hole 811. Note that, in the pressing section 81, not only the feed-stop section 812 but also a slip-stop section for preventing the holding section 82 from coming off the front of the hole 811 may be provided.

A base section 823 of the holding section 82 corresponds to a hole 811 and is circular. The holding section 82 includes holes 824, into which fingertips can be inserted, at two points across the center point on the surface of a convex section 821. The holes 824 serve as handholds when the holding section 82 is rotated.

A support structure (not shown in the figures) in this embodiment immovably locks the holding section 82 in the first position and the second position. The lock is performed in a certain angle range of rotation (indicated by an arrow in FIG. 13B) of the base section 823 with respect to the hole 811. In the lock state, the support structure disables movement of the base section 823 in a turning axis direction (indicated by an arrow in FIG. 13A). Outside the angle range, the support structure releases the lock and enables the movement of the base section 823 in the turning axis direction.

In this way, according to the third embodiment, by causing the holding section 82 to enter and exit the hole 811 and rotating the holding section 82, it is possible to continuously move the holding section 82 between the first position and the second position without detaching the holding section 82 from the pressing section 81. Therefore, it is possible to obtain effects same as the effects in the first embodiment.

Fourth Embodiment

A fourth embodiment is explained below. This embodiment is a modification of the first embodiment. In the explanation of this embodiment, explanation concerning portions same as the portions in the first embodiment is omitted. Portions different from the portions in the first embodiment are explained. In this embodiment, the portions same as the portions in the first embodiment are denoted by the same reference numerals and signs.

Figure 14A:
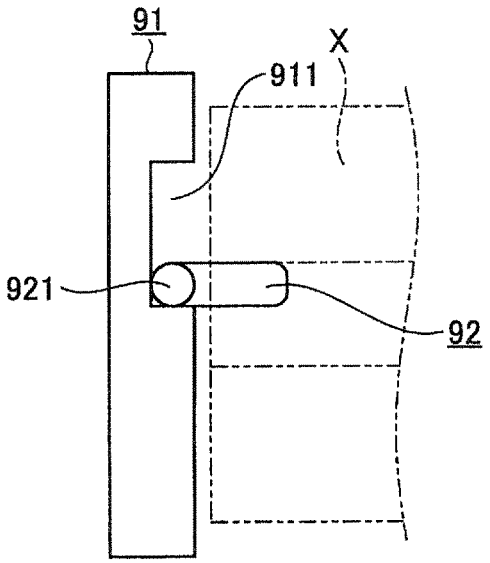
Figure 14B:
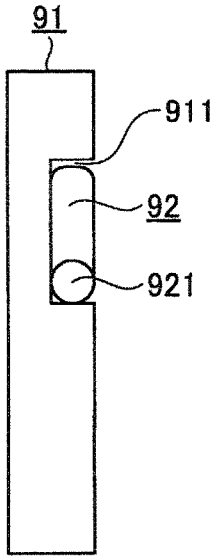

FIGS. 14A and 14B are longitudinal sectional views of a pressing section 91 and a holding section 92 in the fourth embodiment. FIG. 14A shows a state in which the holding section 92 is present in the first position. FIG. 14B shows a state in which the holding section 92 is present in the second position.

The holding section 92 can be housed in a concave section 911 formed in the pressing section 91. The holding section 92 is configured to be capable of entering and exiting the concave section 911 by turning around a turning shaft 921.

Note that, in the second position, the holding section 92 is fixed not to suddenly exit the concave section 911 by a not-shown lock mechanism.

In this way, according to the fourth embodiment, by turning the holding section 92, it is possible to continuously move the holding section 92 between the first position and the second position without detaching the holding section 92 from the pressing section 91. Therefore, it is possible to obtain effects same as the effects in the first embodiment.

As explained above, according to the first to fourth embodiments, by enabling the holding sections 62, 72, 82, and 92 to be displaced between the first position and the second position, it is possible to provide the printer 1 for both of a label and a receipt capable of performing printing in both of the type for holding the rolling center of the roll paper X and the throwing-in type.

Note that, in the embodiments, in order to prevent a loss of the holding sections (62, 72, 82, and 92) and the pressing sections (61, 71, 81, and 91), it is possible to move the holding sections between the first position and the second position without detaching the holding sections and the pressing sections. However, in implementation, the printer is not limited to the configuration explained above (un-detachable). The printer only has to be at least a printer for a label and a receipt in which the holding sections are configured to be displaceable between the first position and the second position.

The several embodiments are explained above. However, the embodiments are presented as examples and are not intended to limit the scope of the invention. These new embodiments can be implemented in other various forms. Various omissions, substitutions, and changes can be performed without departing from the spirit of the invention. These embodiments and modifications of the embodiments are included in the scope and the gist of the invention and included in the inventions described in claims and the scope of equivalents of the inventions.

What is claimed is:

1. A printer, comprising:

a sheet holding section configured to hold roll paper formed by rolling a printing target sheet, a pair of pressing sections configured to hold the roll paper from both side ends, a holding section provided in each of the pressing sections, the holding section being displaceable to a first position where the holding section projects to a side opposed to a side end portion of the roll paper and a second position without detaching where the holding section does not project and entering a cylindrical portion in a rolling center of the roll paper in the first position to hold the roll paper.

2. The printer according to claim 1, further comprising:

a support mechanism configured to support the holding section to be movable between both of the first position and the second position.

3. The printer according to claim 2, wherein the support mechanism rotatably supports the holding section and moves the holding section between the first position and the second position according to the rotation.

4. The printer according to claim 3, wherein the holding section comprises, on a rear surface of a surface opposed to the side end portion of the roll paper in the first position, a surface opposed to the side end portion of the roll paper in the second position, and the support mechanism supports the holding section to be rotatable around a rotating shaft provided in parallel to the side end portion of the roll paper.

5. The printer according to claim 3, wherein the pressing section comprises a hole that the holding section can enter and exit along a width direction of the roll paper, and the support mechanism supports, with a female screw provided in an inner circumference of the hole and a male screw provided in an outer circumference of the holding section and meshing with the female screw, the holding section to be rotatable around a rotation axis along the width direction of the roll paper and movable in a direction in which the holding section enters and exits the hole according to the rotation.

6. The printer according to claim 1, wherein the pressing section comprises a hole having a shape substantially coinciding with an outer circumferential shape of the holding section.

7. The printer according to claim 1, further comprising:

a whirl-stop section provided between the holding section and the pressing section.

8. The printer according to claim 7, wherein the whirl-stop section comprises a tab and a tab grasping section.

9. The printer according to claim 8, wherein the tab grasping section comprises a pair of claw members and a positioning member.

10. The printer according to claim 1, wherein the pressing section comprises a tab grasping section and a concave section on a lower side of the tab grasping section.

11. A paper roll holder, comprising:

a pair of pressing sections configured to hold roll paper from both side ends, a holding section provided in each of the pressing sections, the holding section being displaceable to a first position where the holding section projects to a side opposed to a side end portion of the roll paper and a second position without detaching where the holding section does not project and entering a cylindrical portion in a rolling center of the roll paper in the first position to hold the roll paper.

12. The paper roll holder according to claim 11, further comprising:

a support mechanism configured to support the holding section to be movable between both of the first position and the second position.

13. The paper roll holder according to claim 12, wherein the support mechanism rotatably supports the holding section and moves the holding section between the first position and the second position according to the rotation.

14. The paper roll holder according to claim 13, wherein the holding section comprises, on a rear surface of a surface opposed to the side end portion of the roll paper in the first position, a surface opposed to the side end portion of the roll paper in the second position, and the support mechanism supports the holding section to be rotatable around a rotating shaft provided in parallel to the side end portion of the roll paper.

15. The paper roll holder according to claim 13, wherein the pressing section comprises a hole that the holding section can enter and exit along a width direction of the roll paper, and the support mechanism supports, with a female screw provided in an inner circumference of the hole and a male screw provided in an outer circumference of the holding section and meshing with the female screw, the holding section to be rotatable around a rotation axis along the width direction of the roll paper and movable in a direction in which the holding section enters and exits the hole according to the rotation.

16. The paper roll holder according to claim 11, wherein the pressing section comprises a hole having a shape substantially coinciding with an outer circumferential shape of the holding section.

17. The paper roll holder according to claim 11, further comprising:

a whirl-stop section provided between the holding section and the pressing section.

18. The paper roll holder according to claim 17, wherein the whirl-stop section comprises a tab and a tab grasping section.

19. The paper roll holder according to claim 18, wherein the tab grasping section comprises a pair of claw members and a positioning member.

20. The paper roll holder according to claim 11, wherein the pressing section comprises a tab grasping section and a concave section on a lower side of the tab grasping section.

* * * * *